United States Patent [19]

Broyles

[11] Patent Number: 4,876,750

[45] Date of Patent: Oct. 31, 1989

[54] WATER CLOSET AND BIDET APPARATUS

[76] Inventor: Michael T. Broyles, 7720 Pinkney St., Omaha, Nebr. 68134

[21] Appl. No.: 96,511

[22] Filed: Sep. 11, 1987

[51] Int. Cl.[4] ..... A47K 3/20

[52] U.S. Cl. ..... 4/420.4; 604/150; 4/444

[58] Field of Search ..... 4/420.1, 420.2, 420.3, 4/420.4, 420.5, 443, 444, 445, 446, 447, 448, 363; 222/389, 387; 604/257, 150

[56] References Cited

U.S. PATENT DOCUMENTS

| | | | |
|---|---|---|---|
| 716,910 | 12/1902 | Lübbecke | 222/389 |
| 1,065,351 | 6/1913 | Fyfe | 604/150 |
| 1,169,524 | 1/1916 | Baker | 222/389 |
| 1,473,979 | 11/1923 | Simmons | 604/150 |
| 1,752,782 | 4/1930 | Burton | 4/448 |
| 1,988,133 | 1/1935 | Myers | 4/420.1 |
| 3,594,826 | 7/1971 | Maurer | 4/420.2 |
| 3,662,407 | 5/1972 | Colucci | 4/420.2 |
| 3,810,260 | 5/1974 | Lodi | 4/420.4 |
| 3,995,326 | 12/1976 | Umann | 4/7 |
| 4,142,260 | 3/1979 | Snyder | 4/228 |
| 4,259,754 | 4/1981 | Bader et al. | 4/448 |
| 4,287,618 | 9/1981 | Silver | 4/443 |
| 4,304,016 | 12/1981 | Oguma | 4/420.2 |
| 4,312,082 | 1/1982 | Murphy et al. | 4/227 |
| 4,371,993 | 2/1983 | Patrick | 4/448 |
| 4,596,058 | 6/1986 | Nourbakhsh | 4/420.1 |
| 4,764,997 | 8/1988 | Anderson et al. | 4/420.3 |

FOREIGN PATENT DOCUMENTS

| | | | |
|---|---|---|---|
| 204793 | 5/1939 | Switzerland | 4/420.3 |

*Primary Examiner*—Henry J. Recla
*Assistant Examiner*—Linda J. Sholl
*Attorney, Agent, or Firm*—Welsh & Katz, Ltd.

[57] ABSTRACT

A plumbing fixture that is uniquely designed to function as a toilet or water closet, and as a bidet is disclosed. The fixture also includes a mechanism for administering a douche or medicinal solution, and has provision for dispensing soap and also includes an auxiliary spraying device for use as a cleansing apparatus. The fixture is adapted for connection to sources of hot and cold water and has a control means that enables the user to regulate the temperature of the water that is provided by the auxiliary spraying device and by the douche or medicinal administering mechanism. The fixture is designed for use as a toilet and as a bidet without manipulation, and for administering a douching solution with relative ease. The preparation of the douching or medicinal solution is facilitated by the capability of removing the container that holds such a solution, and the container can be easily cleaned after such use.

42 Claims, 3 Drawing Sheets

TO 62
TO 64
TANK
COLD
HOT
V

WATER CLOSET AND BIDET APPARATUS

The present invention generally relates to plumbing fixtures, and more particularly relates to a fixture that functions as a water closet and as a bidet. The fixture has additional features that enable the dispensing of medicinal fluids.

Bidets appeal to a significant number of consumers and are being installed in ever increasing numbers. While prospective purchasers who live in existing dwellings may desire a bidet, space constraints may preclude the installation of a bidet in many existing bathrooms. Additionally, since a bidet often represents an additional fixture that must be purchased and installed, a substantial expense is involved that some prospective purchasers may find difficult to justify, even though they would prefer to have a bidet.

Additionally, while a bidet may be desirable for administering douches or medicinal solutions, the application of such a douche or medicinal solution is often done using some procedure and equipment that is independent of the bidet itself.

Accordingly, it is an object of the present invention to provide an improved plumbing fixture that functions as a sanitary closet or toilet, as well as a bidet, in addition to providing other desirable features.

It is another object of the present invention to provide such an improved fixture that includes an improved medicinal fluid dispensing mechanism that is adapted to enable a user to administer a douching or medicinal solution in a convenient manner.

Yet another object of the present invention is to provide such an improved fixture that is uniquely designed to function as a water closet, and yet can be used as a bidet without significant reconfiguration or bother.

Still another object of the present invention lies in the provision of additional features, such as an auxiliary cleaning nozzle that can be used for hygienic purposes and a soap dispenser that is integrally designed as a part of the fixture.

Another object of the present invention lies in the provision of a medicinal fluid dispensing mechanism which dispenses a medicinal fluid to be dispensed, and which is thereafter self-cleansed because the mechanism is connected to the water supply which effectively purges the mechanism after the solution is depleted.

It is still another object of the present invention to provide such an improved fixture that is easy to use, is aesthetically attractive, and is economical in terms of initial cost and installation.

Other objects and advantages will become apparent upon reading the following detailed description, while referring to the attached drawings, in which.

DETAILED DESCRIPTION OF THE INVENTION

Broadly stated, the present invention is directed to a plumbing fixture that is uniquely designed to function as a toilet or water closet, and as a bidet. The fixture also includes a mechanism for administering a douche or medicinal solution, and has provision for dispensing soap and also includes an auxiliary spraying device for use as a cleansing apparatus. The fixture is adapted for connection to sources of hot and cold water and has a control means that enables the user to regulate the temperature of the water that is provided by the auxiliary spraying device and by the douche or medicinal administering mechanism. The fixture is designed for use as a toilet and as a bidet without manipulation, and for administering a douching solution with relative ease. The preparation of the douching or medicinal solution is facilitated by the capability of removing the container that holds such a solution, and the container can be easily cleaned after such use.

Figure 1:
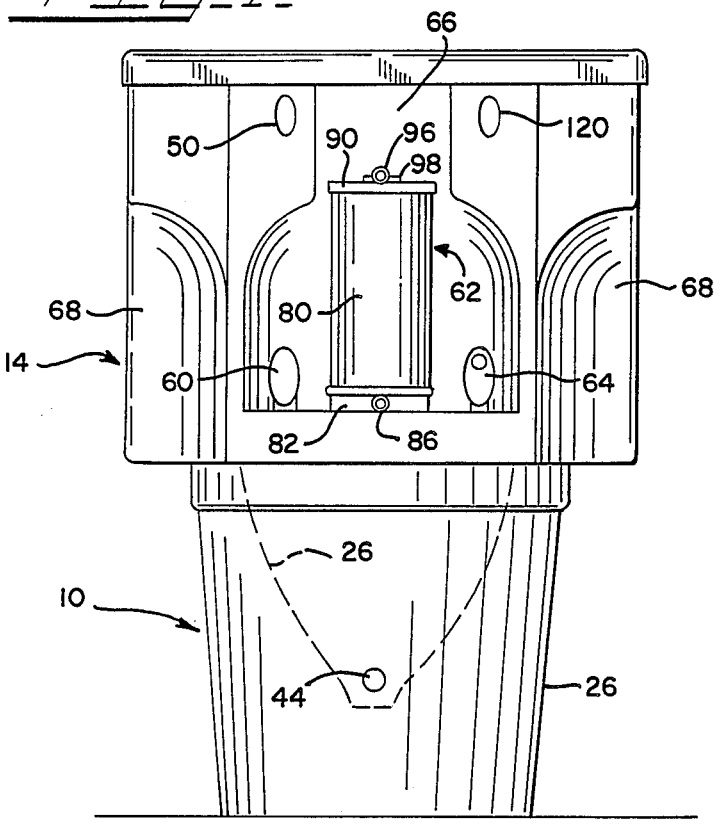
FIG. 1 is a front plan view of the present invention.
Figure 2:
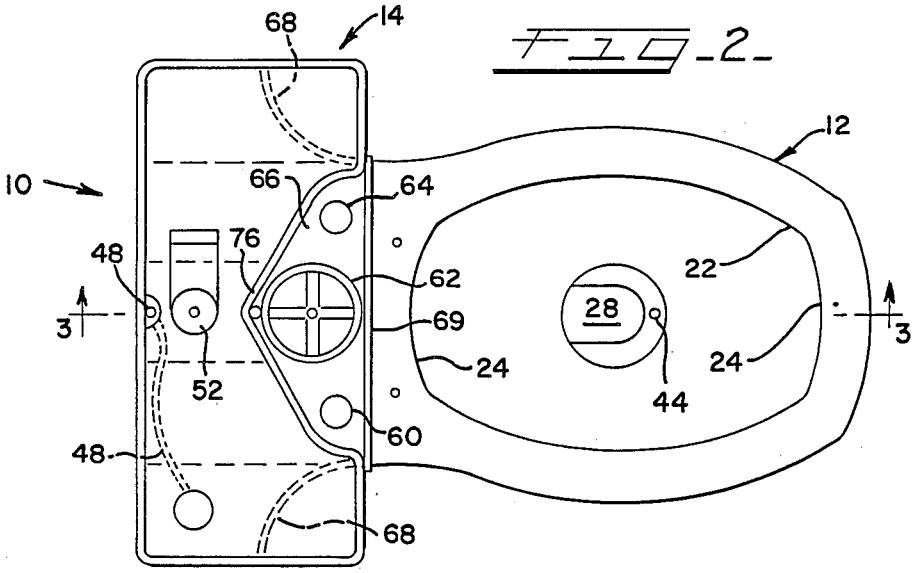
FIG. 2 is a top plan view of the present invention.
Figure 3:
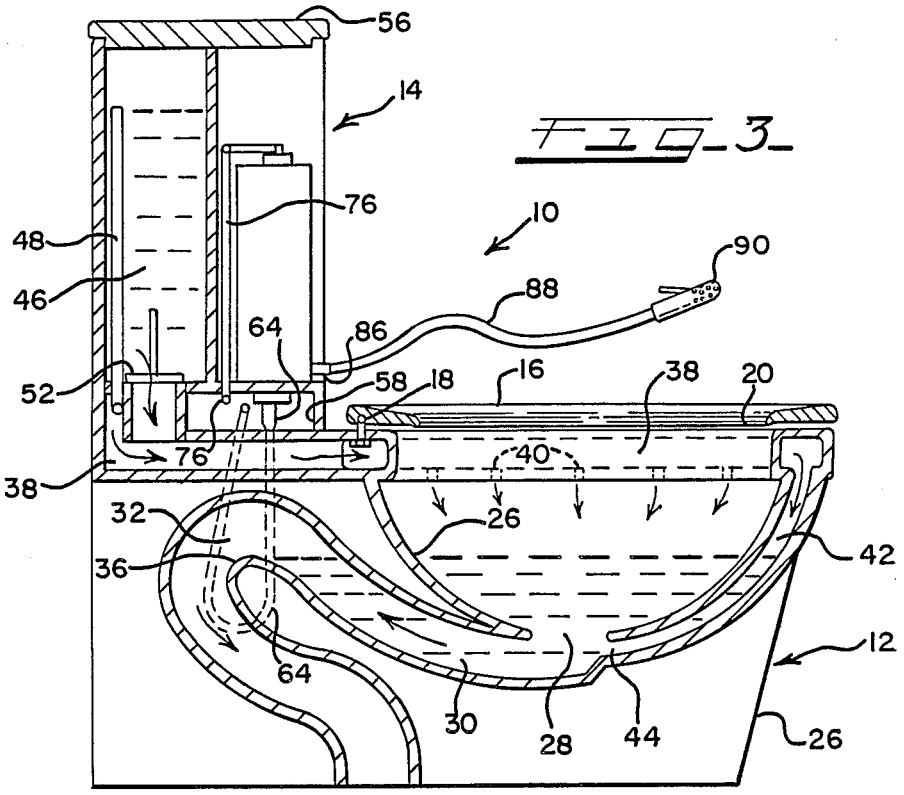
FIG. 3 is a cross-sectional view of the present invention, and is taken generally along the line 3—3 of FIG. 2.
Figure 4:
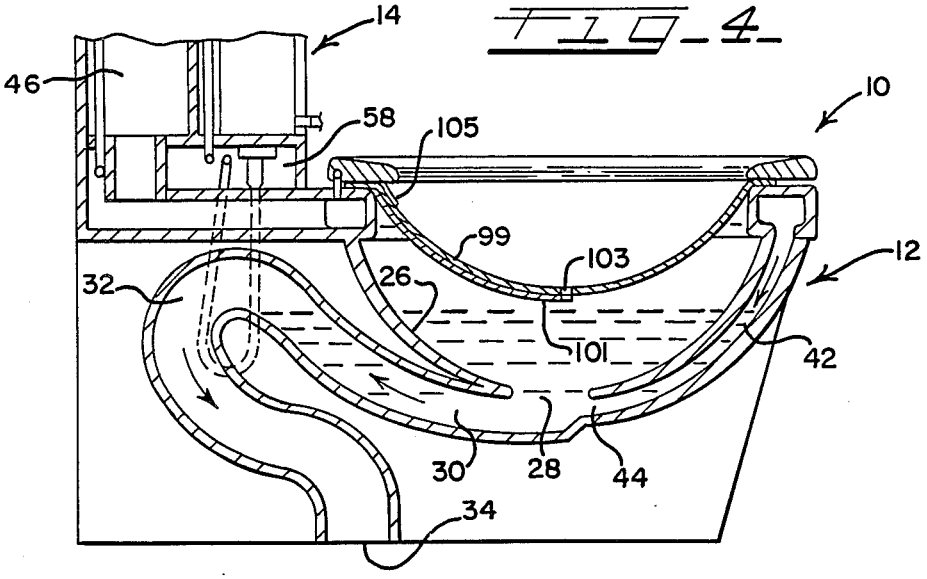
FIG. 4 is a cross-sectional view of the present invention similar to that shown in FIG. 3 with portions removed, and including a bowl insert that is particularly useful when the fixture functions as a bidet.

Turning now to the drawings, a front view of the fixture of the present invention is shown in FIG. 1, a top plan view of the fixture is shown in FIG. 2, and cross-sectional side views of the fixture are shown in FIGS. 3 and 4. The fixture, indicated generally at 10, includes a bowl means 12 and a tank means 14, and preferably includes a seat 16 that is attached to the bowl means by a hinge mechanism 18. As is best illustrated in the cross-sectional view of the seat shown in FIGS. 3 and 4, the entire bottom of the inner periphery of the seat preferably has a lower lip 20 extending below the general plane of the bottom of the seat which directs any dripping of water that may occur to drip into the bowl. A pivotable lid (not shown) is preferably provided for the seat 16 and is also preferably completely removable from the seat so that the lid does not interfere with access to the mechanisms that are involved when the fixture is used as a bidet.

As best shown in FIG. 2, the bowl means 12 has a generally elliptically shaped opening with curved ends 24 that have a lesser curvature than that of the sides of the opening. The bowl means 12 has a base 26, which in the illustrated embodiment supports the fixture from the floor. It should be understood, however, that the base could easily be designed to be hung from the wall, as is well known in the art. The bowl means defines a fluid reservoir 26 that primarily functions as the bowl of the toilet fixture. The reservoir 26 has a discharge opening 28 in the bottom thereof for flushing the reservoir after use. As shown in FIGS. 3 and 4, the opening 28 is connected to a siphon channel 30 that is preferably integrally formed in the bowl means, and the siphon channel extends from the discharge opening rearwardly and upwardly to a corner segment 32 and then downwardly and forwardly to the bottom opening 34 that is adapted for mounting to a plumbing fitting installed in a dwelling in the customary manner. As is well known, the elevation of water or other fluid in the reservoir 26 is determined by the elevation of the lower surface of the siphon channel 30 at the corner segment 32, and is marked at 36 in FIGS. 3 and 4.

To flush the reservoir 26, the bowl means includes a preferably integrally formed flushing channel 38 which extends from the rear of the bowl means where it is in fluid communication with the tank means and extends forwardly to the opening 22 and extends around the entire perimeter of the opening. As best shown in FIG. 3, the channel 38 includes a plurality of apertures 40 for directing water into the reservoir for flushing the same. The flushing channel 38 also includes a segment 42 that is in communication with the front center thereof and this segment extends downwardly to an opening 44 immediately adjacent to the discharge opening 28 of the reservoir. This segment communicates a concentrated flow of water into the discharge opening during flushing that is directed toward the siphon channel to provide a more effective flushing action.

In accordance with an important aspect of the present invention, the tank means 14 not only provides the water for flushing the bowl means, but it contains other apparatus that comprises important novel features of the invention. The tank means 14 is preferably integrally formed with the bowl means, but may be fabricated as a separate unit and attached to the bowl means. If it is separately made, care must be taken to provide suitable sealing of the two means so that leakage does not occur. Referring to FIG. 3, the tank means includes a tank supply reservoir 46 containing water for flushing the bowl means. The supply reservoir has a supply conduit 48 connected to a source of water, preferably the cold water line of a dwelling, and includes a valve mechanism of conventional design which opens to fill the supply reservoir after a flushing action has been initiated. A flushing lever or push-button 50 (see FIG. 1) is connected to a flushing mechanism (not shown, but of conventional design) which, when actuated, causes a valve 52 to be lifted, thereby causing the water in the reservoir to drain through an opening 54 into the flushing channel 38 of the bowl means. A removable top 56 is located on the upper surface of the tank means 14 to provide access to the interior of the tank means for maintenance of the flushing mechanism. The tank means 14 has a plumbing raceway 58 for a control valve 60, a medicinal dispensing means 62 and an auxiliary spray means 64, all of which are illustrated in FIGS. 1–3.

The shape of the tank means is uniquely designed to provide a center recess 66 for locating the control valve 60, medicinal dispensing means 62 and auxiliary spray means 64, and also contains side recesses 68 that contribute to the comfort of the user when used as a bidet. A flat panel 69 may be provided to cover the front center recess 66 for esthetic reasons as shown in FIG. 2. In this regard, when the fixture is being used as a bidet, the person will preferably sit on the seat in a position facing the tank means. Since the tank means is wider than the bowl means, the user's knees may extend in the proximity of the tank means, and the side recesses provide clearance for the user's knees. As best shown in FIGS. 1 and 2, the recesses 68 extend from a location generally coextensive from the sides of the bowl means to the sides of the tank means, extend vertically upwardly to an elevation higher than a user's knees, and gradually merge to the outer sides of the tank means, had the recesses not been provided.

Figures 5, 6, 7, 8, 9:
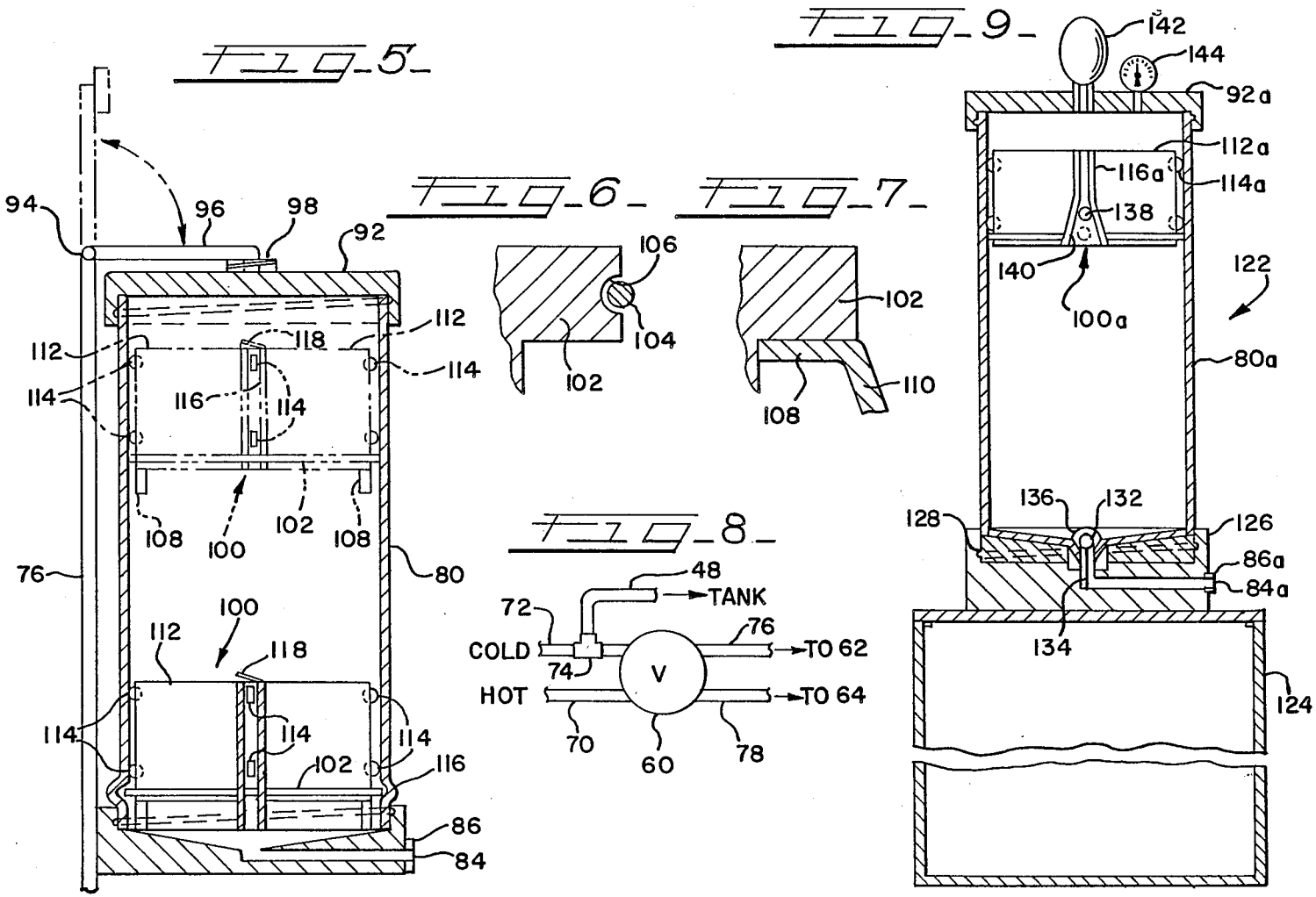
FIG. 5 is an enlarged cross-sectional view of a portion of the apparatus shown in FIGS. 1–3, particularly illustrating significant portions of the douche or medicinal dispensing mechanism.
FIG. 6 is a detailed cross-sectional view of a portion of the mechanism shown in FIG. 5.
FIG. 7 is a detailed cross-sectional view of an alternate embodiment of the portion of the mechanism shown in FIG. 6.
FIG. 8 is a schematic diagram of the internal fluid supply control means; and, FIG. 9 is an alternate embodiment of the mechanism shown in FIG. 5, when configured as a stand-alone mechanism apart from the fixture shown in FIGS. 1–4.

Turning now to FIG. 8, there is shown a schematic diagram of the plumbing riser for the medicinal dispensing means 62, the tank reservoir 46, and the auxiliary spray means 64, and comprises respective hot and cold supply lines 70 and 72, the latter of which connects to a T shaped fitting 74 or comparable fitting which is connected to line 46 and to the control valve 60. The control valve has outlet lines 76 and 78 which communicate water to the medicinal dispensing means 62 and the auxiliary spray means 64, respectively. The control means is of conventional design as is adapted to control the temperature of the water that is passed to the lines 76 and 78, and to control the flow of water to these lines. Manipulation of the control valve 60 enables a user to regulate the temperature of the water that is communicated to the lines 76 and 78 by varying the proportion of hot and cold water from the supply lines 70 and 72, and can also control which of the outlet lines 76 and 78 to which water is communicated. The location of the control valve 60 is conveniently placed in the recess 66, so that a user can easily adjust the temperature of the water that may be used and to also easily direct the flow thereof to the medicinal dispensing means 62 or the auxiliary spray means 64, as desired.

In accordance with an important aspect of the present invention, the medicinal dispensing means 62 generally comprises an elongated cylindrical container 80 which is preferably made of clear plastic material, but which can be fabricated of metal or other suitable material. As shown in FIGS. 1, 2 and 5, the dispensing means 62 has a base 82 containing an outlet 84 fitted with a conventional quick connect connector 86 to which a removable flexible hose 88 can be removably attached. A nozzle 90 that can be turned on and off to selectively dispense fluid from the dispensing means is provided at the outer end of the hose 88. The dispensing means 62 has a removable top 92 which has sealing means to prevent the container from leaking when water is directed to the dispensing means and the hose 88 is attached, but the nozzle 90 is off. The supply line 76 extends up the recess at a location rearwardly of the container 80 and is preferable comprised of a rigid conduit. An adjustable elbow joint 94 is connected to another line segment 96, also preferably a rigid conduit that terminates in a removable quick connect connector 98 that is attachable to the top 92. During operation, it can therefore be understood that when water pressure is applied to the line 76, and the connector 98 and the top 92 are connected in place as shown in FIG. 5, water can flow into the container and be dispensed through the hose 88 and nozzle 90 for use.

It should also be apparent that the connector 98 can be disconnected and pivoted upwardly to the position shown in phantom in FIG. 5 and the container can thereafter be removed for cleaning, or for the purpose of preparing a medicinal solution or douche for subsequent application. It should be understood that while the lines 76 and 96 are preferable rigid conduits interconnected by the pivotable elbow, the function of these components may be carried out by a single flexible hose.

When the fixture is used as a bidet, it is desireable that a bowl insert 99 be provided, which is in the shape of the bowl inside surface, and is adapted to fit into the inside of the opening of the bowl 26. A slidable stop means 101 is adapted to cover an aperture 103 in the bowl insert and a handle 105 that extends to the upper side of the insert near the back of the bowl enables the user to selectively open and close the stop means 101 as desired. The bowl insert 99 can be easily removed by raising the seat 16 and lifting the insert 99 out.

To facilitate convenient and effective use in dispensing medicinal fluids, the container 62 can be removed from the fixture as previously described, and the top 92 can be removed, revealing an internal cartridge means, indicated generally at 100, which can be removed from the container through the top opening. The function of the cartridge means is to isolate a medicinal fluid from the water that is being admitted to the container through connector 98. When the cartridge means 100 is removed, a medicinal solution may be placed in the container, the cartridge means replaced, and the container may be reinstalled in the center recess 66, and the connector 98 can then be connected. When water pressure is applied through line 76, the volume of the container above the cartridge will be filled with water and provide a downward force on it, which will create fluid pressure on the medicinal solution, so that when the nozzle 90 is opened, the medicinal fluid will be expelled through the nozzle. The cartridge means isolated the medicinal fluid from the water on its upper surface, and as the medicinal fluid is dispensed, the cartridge means will gradually travel downwardly until it abuts the bottom of the container.

As best shown in FIG. 5, the cartridge means generally comprises a flat circular bottom 102 having a sealing means between its outer periphery and the inside wall of the container, which sealing means may comprise an O-ring seal 104 that rests in an annular recess 106 (see FIG. 6), or it may also comprise a seal comprising a circular annulus 108 attached to the underside of the bottom 102, which annulus has an integrally formed downwardly and slightly outwardly directed extension 110 (see FIG. 7). The cartridge means 100 preferably has a number of legs 108 attached to the underside of the bottom 102 for the purpose of limiting the travel of the cartridge means in the downward direction to an elevation that is a predetermined distance from the bottom inside surface of the container. The cartridge also has a number of vertical extensions 112 extending upwardly of the bottom 102 and these extensions have rollers 114 or the like to reduce friction between the cartridge means and the insider of the container during movement of the cartridge means. A channel 116 is provided in the center of the extensions 112 which permit flow of fluid from the underside of the bottom 102 to the upper side, that flow being limited to only the upward direction by a one way valve 118, which is preferably a flap valve as shown, but which may be a ball valve or other valve.

Since the flow of water from the upper side of the cartridge bottom 102 to the underside is substantially prohibited by the seal and the one way valve, provision is made to permit flow of water through the container after the medicinal fluid has been depleted and the cartridge is at its lowest elevation in the container. This is accomplished by forming a slight radially increased bulge 116 in the container at the elevation of the bottom 102 when the cartridge is in its lower most position. The bulge 116 permits flow of water around the outside of the bottom 102 which facilitates a purging action of the hose and nozzle and to also permit further cleansing action by the user with water.

The auxiliary spray means 64 is provided adjacent the medicinal dispensing means and comprises a flexible hose 32 to which a nozzle is attached, and the nozzle preferable has a flow control lever to selectively dispense water. The flexible hose 32 is preferably of the type which can be extended from the position shown in FIG. 1, much the same as a kitchen sink spray device. The fixture may also contain a soap dispensing device 120 having a soap dispensing actuator protruding through the tank wall and the actuator is suitably connected to and is in communication with a reservoir of soap that is preferable located inside the tank. The normal water elevation of the tank is preferably below the elevation of the soap dispensing actuator, and therefore no sealing means needs to be provided.

Referring to FIG. 9, an alternate embodiment 122 of the medicinal dispensing means is illustrated, and is particularly adapted to function as a stand alone unit that can be used to dispense medicinal fluids in an existing bathroom that may not be equipped with the fixture previously described. The dispensing means is of similar construction to that shown in FIGS. 5–8, and reference numbers to common parts are indicated where applicable, with the reference numbers carrying an "a" designation. The dispensing means 122 is shown to rest on a stand 124 which may be included if desired. The dispensing means 122 has a base 126 which contains the outlet **84*a* and quick connect connector 86*a*, but the container 80*a* is separable from the base 126 and is preferably threadably connected by interacting threads 128 to the base as shown in the drawing of FIG. 9. The container 80*a* has a center outlet 130 at the bottom thereof through which fluid can be communicated to the outlet 84*a*, and a ball valve 132 is preferably provided to seal the outlet when fluid is introduced into the container 80*a* when it is separated from the base 126. A needle 134 is provided in the bottom of the base 126 and has sufficient length to elevate the ball 132 when the container is attached to the base, and thereby permit fluid to flow from the container to the outlet 84*a* during use. The ball 132 is preferably confined to the immediate location shown in the drawing by a cage or screen 136 that retains the ball but permits fluid flow. The cartridge means 100*a* is of substantially similar construction as the cartridge means 100 shown in FIG. 5, but may contain a ball valve 138, rather than the flap valve 118 shown in FIG. 5. The ball 138 is housed in a cone shaped center portion 140 of the cartridge means as illustrated in FIG. 9. The ball valve 138 is preferably made of lightweight material such as plastic or the like that will float on water or other liquid so that when the cartridge means 100*a* is inserted into the container filled with fluid, the fluid will push the ball 138 upwardly into sealing contact. The top 92*a* of the dispensing means 122 is removable as previously described with respect to top 92, but included a resilient pumping means 142 that can be squeezed to increase the air pressure in the upper portion of the container above the cartridge means 100*a*. The increased air pressure developed by squeezing the pumping means causes the cartridge means to exert a downward pressure on the fluid within the container and therefore cause the fluid to be dispensed from outlet 84*a* with some increased pressure that is proportional to the pressure developed by the pumping means. A pressure gauge 144 may be provided in the top 92*a*** if desired.

From the foregoing, it should be understood that an improved plumbing fixture has been shown and described that is uniquely designed to conveniently function as a toilet and as a bidet, and includes other desireable attributes of dispensing medicinal fluids to a user. The fixture is adapted to provide these functional features in an economical single package that requires little additional installation time and expense as compared to a conventional toilet.

Although various embodiments of the invention have been shown and described in full herein, there is no intention to limit the invention to the details of such embodiments. On the contrary, it is the intention that the invention cover all of the various modifications, alternatives, substitutions and equivalents that may fall within the spirit and scope of the invention as set forth in the appended claims.

Various features of the invention are set forth below.

What is claimed is:

1. Water closet and bidet apparatus, comprising:

bowl means having an upper enlarged opening and defining a fluid reservoir having a generally elongated hemispheric shape, said bowl means having a discharge opening in the bottom portion thereof and connected to a discharge siphon, said bowl means having a flushing channel for passing fluid into said reservoir;

tank means located rearwardly and upwardly of said bowl means and defining a reservoir for receiving fluid for flushing said bowl means, said tank means having a lower outlet opening in communication with said flushing channel, and said tank means having a width that exceeds the width of said bowl means so that the sides of said tank means extend beyond the sides of said bowl means;

discharge valve means for discharging fluid to said flushing channel;

control means adapted to be operably connected to a source of fluid supply and to said discharge valve means, said control means including a manually operable control actuator that extends exteriorly of said tank means, which when actuated, opens said discharge valve means to discharge fluid from said tank means to said discharge channel, and thereby activates said source of fluid supply to replenish the fluid in said tank means;

means for dispensing fluid comprising a container adapted to be connected to a source of fluid and an outlet means for dispensing fluid, said container being located adjacent the rear portion of said bowl means and the front portion of said tank means, said container being removable from said apparatus;

flow control means for interconnecting said fluid dispensing means with sources of hot and cold fluid, and including a manually adjustable valve means for controlling the proportion of hot and cold fluid to control the temperature of the fluid entering said fluid dispensing means and for controlling the volume of flow thereof; and, a recess located in the outer front and said walls on each side of said tank means, each recess extending from a portion generally coextensive with the upper surface of said bowl means to a higher elevation, and extending from the side wall interiorly to a location generally coextensive with the sides of said bowl means, said recesses defining openings in which the knees of a user may extend when the user is sitting over the bowl means when facing the tank means.

2. Apparatus as defined in claim 1 including a toilet seat that is pivotable between raised and lowered positions, said seat being pivotally attached to said bowl means near the rear portion of said bowl means.

3. Apparatus as defined in claim 1 wherein said discharge siphon is integrally formed within said bowl means and comprises a channel that extends from said discharge opening rearwardly and upwardly and thereafter downwardly to the bottom of said bowl means.

4. Apparatus as defined in claim 1 wherein the flushing channel extends from the rear portion of said bowl means to the upper opening, said channel being integrally formed in said bowl means and having a plurality of apertures for communicating fluid to the periphery of said opening into said reservoir.

5. Apparatus as defined in claim 4 wherein said flushing channel extends substantially around the entire opening and further extends from the front portion of the bowl means downwardly to the discharge opening and communicates fluid directly to said discharge siphon.

6. Apparatus as defined in claim 1 wherein said control actuator comprises a pivotally rotatable lever that extends to the exterior of said tank means, which when rotated, actuates said control means.

7. Apparatus as defined in claim 1 wherein said control actuator comprises a depressible actuator that extends to the exterior of said tank means, which when depressed actuates said control means.

8. Apparatus as defined in claim 1 wherein said control means is connected to a source of cold fluid, such as the cold water supply of a dwelling.

9. Apparatus as defined in claim 1 wherein said upper opening of said bowl means is generally elliptically shaped with opposite end portions having a lesser degree of curvature than the opposite side portions thereof.

10. Apparatus as defined in claim 1 wherein said fluid dispensing means further includes means for interconnecting said flow control means and said container, said interconnecting means having a connector adapted to be quickly disconnected from said container to facilitate removal of said container, said fluid dispensing means further including a flexible hose adapted to be connected and disconnected from said container and having a manually operable spray nozzle attached to the outer end of said hose.

11. Apparatus as defined in claim 10 wherein said container is an elongated vertical container having a removable top, said top having an aperture for connection with said interconnecting means, said container having an aperture at the lower portion thereof for connection with said flexible hose.

12. Apparatus as defined in claim 11 wherein said container is generally cylindrically shaped and includes a removable cartridge means that is vertically movable within said container, said cartridge means being adapted to isolate fluid below said cartridge means from fluid above said cartridge means.

13. Apparatus as defined in claim 12 wherein said cartridge means includes sealing means located around the outer periphery thereof and adapted to prohibit communication of fluid between said cartridge means and the inside wall of said container throughout substantially the entire extent of vertical movement of said cartridge within said container.

14. Apparatus as defined in claim 13 wherein said container means has a generally expanded diameter of its inner wall at an elevation near the bottom portion thereof adjacent said cartridge means sealing means when said sealing means is at its lowest vertical position, thereby permitting fluid to communicate around said cartridge means when located at its lowest vertical position.

15. Apparatus as defined in claim 13 wherein said cartridge means includes an annular recess in its outer periphery, and said sealing means comprises an O-ring seal located in said annular recess.

16. Apparatus as defined in claim 13 wherein said sealing means comprises a generally flat flexible circular annulus attached to the lower surface of said cartridge means, said annulus having a downwardly and radially outwardly extending portion adapted to contact the inner side wall of said container for the purpose of sealing the same.

17. Apparatus as defined in claim 14 wherein said cartridge means comprises a generally flat circular member and at least three upward extensions, said extensions defining guides for maintaining said circular member perpendicular to the axis of said cartridge means.

18. Apparatus as defined in claim 17 further including roller means carried by said extensions adapted to contact the inner surface of said container means for facilitating vertical movement thereof by reducing friction between said cartridge means and said container.

19. Apparatus as defined in claim 14 wherein said cartridge means includes valve means located therein adapted to permit one way flow of fluid from the underside to the upper side thereof.

20. Apparatus as defined in claim 10 wherein said means for interconnecting said flow control means and said container comprises a flexible hose having a connector attached to its outer end for connecting said hose to said container.

21. Apparatus as defined in claim 10 wherein said means for interconnecting said flow control means and said container comprises a rigid conduit extending to an elevation generally coextensive with the top of said container, said conduit having a flexible joint for pivoting the conduit toward and away from said container, said conduit having a connector attached to its outer end for connecting the same to said container.

22. Apparatus as defined in claim 1 wherein said tank means includes a center recess located at the front thereof adapted to receive said fluid dispensing means.

23. Apparatus as defined in claim 22 further including a generally flat removable panel that is adapted to cover said recess and fluid dispensing means along a plane generally coextensive with the front of said tank means.

24. Apparatus as defined in claim 22 wherein said flow control means is located in said center recess adjacent said fluid dispensing means.

25. Apparatus as defined in claim 24 further including an auxiliary fluid dispensing means connected to said flow control means, said auxiliary fluid dispensing means comprising a flexible hose with a manually operable spray nozzle attached to the outer end thereof, said auxiliary fluid dispensing means being located within said center recess adjacent said container, said flow control means being adapted to control the flow of fluid between said fluid dispensing means and said auxiliary fluid dispensing means.

26. Apparatus as defined in claim 25 wherein said flow control means and said auxiliary fluid dispensing means are located on opposite sides of said container in said center recess.

27. Apparatus as defined in claim 2 wherein said toilet seat has an interior lip extending marginally lower near the interior portion thereof to facilitate dripping fluid to fall into said reservoir.

28. Apparatus as defined in claim 1 further including a removable shallow bowl insert that is adapted to be retained by said bowl means, the lowest extension of said bowl insert being located above the nominal fluid elevation of said reservoir when in operational use.

29. Apparatus as defined in claim 28 wherein said bowl insert includes a bottom drain aperture and an upper overflow aperture, and manually operable drain aperture stop means for selectively retaining fluid within said bowl insert.

30. Apparatus as defined in claim 29 wherein said stop means comprises a slidable valve extending below said bowl insert from said drain aperture to an elevation adjacent the top of said bowl insert and having a handle extending through an opening in said bowl insert so that a user can manually move said slidable valve to selectively open and close the same.

31. Apparatus as defined in claim 22 further including a soap dispenser attached to said tank means, said soap dispenser having a soap reservoir located within said tank means and a soap dispensing means extending through said tank means to the outside thereof, said soap dispensing means being located in said center recess.

32. Apparatus as defined in claim 1 wherein said bowl means includes a base portion that is adapted to support said apparatus when mounted on the floor of a dwelling.

33. A bathroom fixture comprising a water closet, bidet and medicinal dispensing mechanism, comprising:

bowl means having an upper enlarged opening and defining a water reservoir having a generally elongated hemispheric shape, said bowl means having a discharge opening in the bottom portion thereof and connected to a discharge siphon channel, said bowl means having a flushing channel for passing water into said reservoir;

tank means located rearwardly and upwardly of said bowl means and defining a reservoir for receiving water for flushing said bowl means, said tank means having a lower outlet opening in communication with said flushing channel, and said tank means having a width that exceeds the width of said bowl means so that the sides of said tank means extend beyond the sides of said bowl means;

discharge valve means for discharging water to said flushing channel;

control means adapted to be operably connected to a source of water supply and to said discharge valve means, said control means including a manually operable control actuator that extends exteriorly of said tank means, which when actuated, opens said discharge valve means to discharge water from said tank means to said discharge channel, and thereby activates said source of water supply to replenish the water in said tank means;

means for dispensing medicinal fluid comprising a container adapted to be connected to a source of water and an outlet means for dispensing medicinal fluid when such is placed therein or water, said container being located adjacent the rear portion of said bowl means and the front portion of said tank means, said container being removable from said apparatus;

flow control means for interconnecting said fluid dispensing means with sources of hot and cold water and including a manually adjustable valve means for controlling the proportion of hot and cold water to control the temperature of the water entering said fluid dispensing means and for controlling the volume of flow thereof; and, a recess located in the outer front and side walls on each side of said tank means, each recess extending from a portion generally coextensive with the upper surface of said bowl means to a higher elevation, and extending from the side wall interiorly to a location generally coextensive with the sides of said bowl means, said recesses defining openings in which the knees of a user may extend when the user is sitting over the bowl means when facing the tank means.

34. Water closet and bidet apparatus, comprising:

bowl means having an upper enlarged opening and defining a fluid reservoir having a generally elongated hemispheric shape, said bowl means having a discharge opening in the bottom portion thereof and connected to a discharge siphon, said bowl means having a flushing channel for passing fluid into said reservoir;

tank means located rearwardly and upwardly of said bowl means and defining a reservoir for receiving fluid for flushing said bowl means, said tank means having a lower outlet opening in communication with said flushing channel, discharge valve means for discharging fluid to said flushing channel;

control means adapted to be operably connected to a source of fluid supply and to said discharge valve means, said control means including a manually operable control actuator that extends exteriorly of said tank means, which when actuated, opens said discharge valve means to discharge fluid from said tank means to said discharge channel, and thereby activates said source of fluid supply to replenish the fluid in said tank means;

means for dispensing fluid comprising an elongated vertical cylindrical container adapted to be connected to a source of fluid and comprising an outlet means for dispensing fluid, said container being located adjacent the rear portion of said bowl means and the front portion of said tank means, said container being removable from said apparatus;

flow control means for interconnecting said fluid dispensing means with sources of hot and cold fluid, and including a manually adjustable valve means for controlling the proportion of hot and cold fluid to control the temperature of the fluid entering said fluid dispensing means and for controlling the volume of flow thereof;

a removable cartridge means that is vertically movable within said container, said cartridge means being adapted to isolate fluid below said cartridge means from fluid above said cartridge means;

sealing means located around the outer periphery of said cartridge means to prohibit communication of fluid between said cartridge means and the inside wall of said container throughout substantially the entire extent of vertical movement of said cartridge within said container; and a generally expanded diameter of the container inner wall at an elevation near the bottom portion thereof adjacent said cartridge means sealing means when said sealing means is at its lowest vertical position within the container, thereby permitting fluid to communicate around said cartridge means when located at its lowest vertical position.

35. Apparatus as define in claim 34 wherein said cartridge means includes an annular recess in its outer periphery, and said sealing means comprises an O-ring seal located in said annular recess.

36. Apparatus as defined in claim 34 wherein said sealing means comprises a generally flat flexible circular annulus attached to the lower surface of said cartridge means, said annulus having a downwardly and radially outwardly extending portion adapted to contact the inner side wall of said container for the purpose of sealing the same.

37. Apparatus as defined in claim 34 wherein said cartridge means comprises a generally flat circular member and at least three upward extensions, said extensions defining guides for maintaining said circular member perpendicular to the axis of said cartridge means.

38. Apparatus as defined in claim 37 further including roller means carried by said extensions adapted to contact the inner surface of said container means for facilitating vertical movement thereof by reducing friction between said cartridge means and said container.

39. Apparatus as defined in claim 34 wherein said cartridge means includes a valve means located therein adapted to permit one way flow of fluid from the underside to the upper side thereof.

40. Water closet and bidet apparatus, comprising:

bowl means having an upper enlarged opening and defining a fluid reservoir having a generally elongated hemispheric shape, said bowl means having a discharge opening in the bottom portion thereof and connected to a discharge siphon, said bowl means having a flushing channel for passing fluid into said reservoir;

tank means located rearwardly and upwardly of said bowl means and defining a reservoir for receiving fluid for flushing said bowl means, said tank means having a lower closet opening in communication with said flushing channel, discharge valve means for discharging fluid to said flushing channel;

control means adapted to be operably connected to a source of fluid supply and to said discharge valve means, said control means including a manually operable control actuator that extends exteriorly of said tank means, which when actuated, opens said discharge valve means to discharge fluid from said tank means to said discharge channel, and thereby activates said source of fluid supply to replenish the fluid in said tank means;

means for dispensing fluid comprising a container adapted to be connected to a source of fluid and an outlet means for dispensing fluid, said container being located adjacent the rear portion of said bowl means and the front portion of said tank means, said container being removable from said apparatus; flow control means for interconnecting said fluid dispensing means with sources of hot and cold fluid, and including a manually adjustable valve means for controlling the proportion of hot and cold fluid to control the temperature of the fluid entering said fluid dispensing means and for controlling the volume of flow thereof;

means for interconnecting said flow control means and said container, said interconnecting means having a connector adapted to be quickly disconnected from said container to facilitate removal of said container, and said interconnecting means comprising a rigid conduit extending to an elevation generally coextensive with the top of said container, said conduit having a flexible joint for pivoting the conduit toward and away from said container, and said conduit having a connector attached to its outer end for connecting the same to said container.

41. Apparatus as defined in claim 40 wherein said fluid dispensing means further includes a flexible hose adapted to be connected and disconnected from said container and having a manually operable spray nozzle attached to the outer end of said hose.

42. Apparatus as defined in claim 41 wherein said container is an elongated vertical container having a removable top, said top having an aperture for connection with said interconnecting means, and said container having an aperture at the lower portion thereof for connection with said flexible hose.

* * * * *

UNITED STATES PATENT AND TRADEMARK OFFICE

CERTIFICATE OF CORRECTION

PATENT NO. : 4,876,750

DATED : October 31, 1989

INVENTOR(S) : Michael T. Broyles

It is certified that error appears in the above-identified patent and that said Letters Patent is hereby corrected as shown below:

Column 12, line 40, change "closet" to --outlet--.

Signed and Sealed this

Twelfth Day of February, 1991

*Attest:*

HARRY F. MANBECK, JR.

*Attesting Officer*

*Commissioner of Patents and Trademarks*